United States Patent [19]

Tomczuk et al.

[11] Patent Number: 5,009,752

[45] Date of Patent: Apr. 23, 1991

[54] PROCESS AND APPARATUS FOR RECOVERY OF FISSIONABLE MATERIALS FROM SPENT REACTOR FUEL BY ANODIC DISSOLUTION

[75] Inventors: Zygmunt Tomczuk, Orland Park; William E. Miller, Naperville; Raymond D. Wolson, Lockport; Eddie C. Gay, Park Forest, all of Ill.

[73] Assignee: The United States of America as represented by the United States Department of Energy, Washington, D.C.

[21] Appl. No.: 398,578

[22] Filed: Aug. 25, 1989

[51] Int. Cl.[5] ..... C25C 3/00

[52] U.S. Cl. ..... 204/64 R; 204/1.5; 204/213; 204/225; 204/243 R; 204/245; 204/285

[58] Field of Search ..... 204/1.5, 64 R, 213, 204/225, 243 R, 245, 287, 285; 423/3

[56] References Cited

U.S. PATENT DOCUMENTS

| | | | |
|---|---|---|---|
| 745,378 | 12/1903 | Poweck | 204/213 |
| 2,951,793 | 9/1960 | Hansen | 204/1.5 |
| 3,098,028 | 7/1963 | Mullins, Jr. et al. | 204/1.5 |
| 4,596,647 | 6/1986 | Miller et al. | 204/225 |
| 4,814,046 | 3/1989 | Johnson et al. | 204/1.5 |

OTHER PUBLICATIONS

Tomczuk et al., "Laboratory Scale Dissolution Studies of IFR Simulated Fuel Pins", IFR Technical Memorandum No. 96, Oct. 1988.

Gay et al., "Plant-Scale Anodic Dissolution of Unirradiated IRR Fuel Pins", IFR Technical Memorandum No. 114, Jul. 1989.

Battles et al., "IFR Pyrochemical Processes Semiannual report, Oct. 1988—Mar. 1989", IFR Technical Memorandum No. 115, Jul. 1989.

Steunenberg et al., "Preliminary Flowsheet for the Pyroprocessing of Recycled IFR Core Fuel, Blanket Material, and Wastes", IFR Technical Memorandum No. 46, Jul. 1986.

*Primary Examiner*—John E. Niebling
*Assistant Examiner*—David G. Ryser
*Attorney, Agent, or Firm*—Tyrone Davis; Thomas G. Anderson; William R. Moser

[57] ABSTRACT

An electrochemical process and apparatus for the recovery of uranium and plutonium from spent metal clad fuel pins is disclosed. The process uses secondary reactions between $U^{+4}$ cations and elemental uranium at the anode to increase reaction rates and improve anodic efficiency compared to prior art processes. In another embodiment of the process, secondary reactions between $Cd^{+2}$ cations and elemental uranium to form uranium cations and elemental cadmium also assists in oxidizing the uranium at the anode.

15 Claims, 4 Drawing Sheets

PROCESS AND APPARATUS FOR RECOVERY OF FISSIONABLE MATERIALS FROM SPENT REACTOR FUEL BY ANODIC DISSOLUTION

CONTRACTUAL ORIGIN OF THE INVENTION

The United States Government has rights in this invention pursuant to Contract No. DE-AC02-86H10303 between the United States Department of Energy and Argonne National Laboratory.

BACKGROUND OF THE INVENTION

This invention relates to an improvement in the electrochemical separation of uranium and plutonium from spent metal-clad fuel pins, in which essentially complete recovery of uranium and plutonium is achieved at high reaction rates and acceptable levels of anode efficiency, without the need for good electrical contact between the fuel pins and the power source at the anode, and with effective separation of non-uranic fission by-products, as well as cladding materials, so that high purity uranium and plutonium are recovered at the cathode, while preserving the operating metal parts of the electrochemical cell from corrosion.

The recovery of fissionable materials such as uranium and plutonium from spent reactor fuel is often carried out using electrochemical cells of the types described in U.S. Pat. Nos. 4,596,647 and 2,951,793, as well as U.S. Ser. No. 07/117,880 (filed Nov. 5, 1987). U.S. Pat. No. 4,596,647, for example, describes an electrochemical cell incorporating many features that have been found useful. In the process for which that cell is intended, spent metal-clad fuel pins chopped into disc-shaped pieces are loaded into a perforated metal basket which forms the anode of the cell. The basket is immersed in a pool of electrolyte such as an eutectic salt of $CaCl_2$-$BaCl_2$-LiCl, also containing $U^{+3}$ and $U^{+4}$ cations and plutonium cations in solution, which pool in turn floats upon a lower pool of molten cadmium. Both the perforated basket containing the fuel pins and the pool of cadmium are electrically connected as anodes. The cathode assemblies, of which one or more may be employed, may consist of a metallic rod (for uranium deposition), typically of molybdenum/-tungsten or mild steel, contained within a perforated, non-conductive cylindrical casing and provided with means for rotating the rod and casing assembly so as to agitate the electrolyte pool, as described in U.S Pat. No. 4,596,647. Alternatively, one or more molten cadmium cathodes of the type described in U.S. Ser. No. 07/117,880 may be used to recover substantially pure uranium followed by a mixture of uranium and plutonium in a two-step operation.

In operation, the anode basket is first lowered into the electrolyte pool and an electrical potential is imposed between the anodes and the cathode, resulting in the electrochemical oxidation of spent uranium and plutonium from the anode and reduction of their cations to metallic uranium and plutonium at the cathode. In this manner, the uranium and plutonium can be dissolved from the pins without using voltages high enough to cause corrosion of the anode basket material and other fittings, or attack on the metal cladding of the pins. But a significant fraction of the power applied to the anode is used to produce $U^{+4}$ cations instead of $U^{+3}$ cations, a condition that worsens as the voltage is increased. Production of $U^{+4}$ cations that eventually reach the cathode in that higher oxidation state lowers the anodic efficiency (the ratio of uranium and plutonium actually dissolved to the theoretical amount that would have dissolved if all of the current used had actually oxidized fissionable material) below the level that could be achieved if only $U^{+3}$ cations were produced and transported to the cathode, because more amp-hours of current are required to oxidize one mole of uranium to $U^{+4}$ than to $U^{+3}$. Also, when $U^{+3}$ is oxidized to $U^{+4}$ at the anode, dissolution of fuel does not take place, and current is consumed.

It is an object of the present invention to increase the rate of anodic dissolution in the anode basket of such an electrochemical cell. Another object is to provide for complete removal of the uranium and plutonium (including uranium and plutonium that have reacted with the metal cladding of the pins) without need to immerse the anode basket in the cadmium pool. (In prior art devices, even immersing the anode basket in the cadmium pool left undissolved an insoluble layer of uranium and plutonium that had reacted with the cladding.) It is a further object of this invention to improve the anodic efficiency of the operation by reducing the transport of $U^{+4}$ cations to the cathode, and/or once having formed $U^{30\,4}$ at the anode, to cause the $U^{+4}$ to react with elemental U in the spent fuel, producing further fuel dissolution. Yet another object of this invention is to provide an improved anode basket design that operates satisfactorily notwithstanding poor electrical contact between the basket and the spent fuel pins. A final object of this invention is to provide an anode basket design that can be easily and completely cleared of electrolyte salt solution after the dissolution process has been completed, thus facilitating recovery of clean metal cladding, as a process waste.

SUMMARY OF THE INVENTION

The process of the invention includes the steps of (1) loading chopped, spent metal-clad fuel pins into one or more improved anode baskets fabricated of selected metals including iron, stainless steel, and molybdenum that are attached to rotating means; (2) lowering the anode baskets into the electrolyte pool of an electrochemical cell of one of the general types known in the prior art; (3) inducing a flow of electrolyte salt through the packed beds of chopped pins, while supplying electrical current between the improved anode baskets and the cathode; (4) continuing to induce the electrolyte flow and to supply current until all of the uranium and plutonium in the pins has been oxidized at the anode baskets and reduced at the cathode as elemental uranium and plutonium; and (5) raising the improved anode basket or baskets out of the electrolyte pool while continuing to flush electrolyte through and out of them, thus clearing electrolyte salt and drying the metal cladding that remains in the baskets. In one particular embodiment of the process, flushing of the electrolyte out of the anode baskets is accomplished by spinning the baskets about a central axis, thus clearing the electrolyte from the packed beds of chopped pins by centrifugal force.

In another variant of this process, the improved anode basket is designed so as to contain a small amount of liquid cadmium. The electrolyte flushing action is stopped periodically, and the applied voltage is increased so as to oxidize the cadmium to $CdCl_2$, which then reacts chemically with the uranium and plutonium in the pins to produce soluble uranium and plutonium cations and elemental cadmium throughout the packed bed of pins. The flushing action is then resumed, while the voltage is reduced to less than that needed to oxidize cadmium, thus flushing out the uranium and plutonium cations into the bulk electrolyte pool and recovering the cadmium for the next oxidation cycle.

The process of this invention requires an improved anode basket design that induces flow of electrolyte through the packed bed or beds of chopped pins when the basket is rotated. Such a design is required in order to promote the chemical reaction of $U^{+4}$ cations, which form in the proximity of the metal parts of the anode basket, with elemental uranium, to form $U^{+3}$ cations, thus conserving electrical energy and improving anodic efficiency. In one such design, a plurality of boxes made of perforated metal such as iron or molybdenum or stainless steel are affixed to a central shaft, through which the electrical connection is made. Rotation of the shaft about its axis while the perforated boxes are submerged in the electrolyte pool forces electrolyte through the perforations and the packed beds of chopped pins contained in the boxes. In another improved anode basket design, which is especially suited for carrying out the cyclical version of the process, a cylindrical basket is formed coaxially about a central shaft that is hollow and open at its bottom, and that extends upward to connect with the rotating means and the electrical connection. The central shaft is perforated throughout that portion that is enclosed in the basket, and is solid above the basket. The outer walls of the cylindrical basket are solid near the base, and perforated near the top. The bottom of the basket contains means for retaining a small pool of liquid cadmium. The packed bed of pins fills the annular space formed by the central shaft and the cylindrical basket walls. The top of the basket, through which the central shaft protrudes, is closed. Rotation of the basket about the axis of the central shaft forces electrolyte out the perforated section of the upper wall of the basket, and draws fresh electrolyte in through the hole in the bottom of the central shaft by centrifugal force, as in a centrifugal pump.

DESCRIPTION OF THE PREFERRED EMBODIMENTS

The invention will be described with reference to the prior art electrochemical cell shown in FIG. 1, and in embodiments utilizing only one anode basket assembly. But it is &:o be understood that other types of electrochemical cells can be used to practice the process of this invention, and that a plurality of anode basket assemblies also may be used, and that such processes and equipment configurations are within the scope of this invention.

Figure 1:
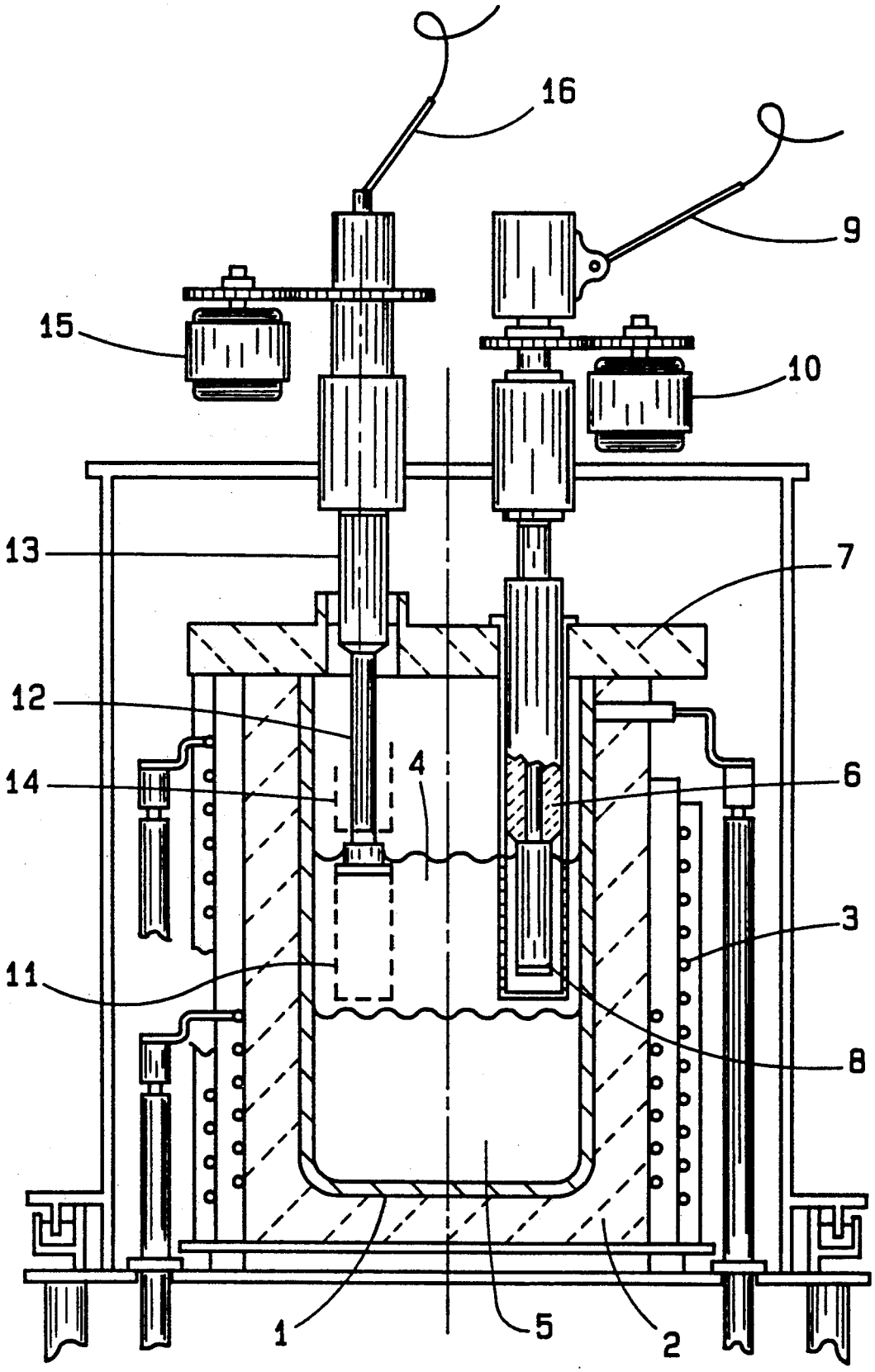
FIG. 1 is a sectional view of one type of a prior art electrochemical cell that might be used in the process of this invention, showing a single-anode version of an anode basket.

FIG. 1 shows a sectional view of an electrochemical cell that can be used to practice the process of this invention. It consists of a cylindrical containment vessel 1 typically made of iron and surrounded by refractory 2. Outside the refractory is heating means 3, typically a high-frequency induction coil, which can maintain temperatures in the range of 450 to 525 degrees centigrade within the cell. Inside the cell is a pool of electrolyte 4, which may consist of an eutectic mixture of $CaCl_2$-$BaCl_2$,-LiCl (roughly 28.8–16.5–54.6 mol %), or preferably an eutectic salt of LiCl-KCl (approximately 45 wt. % LiCl), with both salts also containing $UCl_3/PuCl_3$. The electrolyte floats upon a pool of molten cadmium 5. A cathode assembly 6 enters the top cover 7 of the cell, submerging the cathode in the electrolyte bath 4. The cathode assembly is connected to a power source 9 and may be provided with rotating means 10 in order to provide agitation of the electrolyte pool 4.

The improved anode basket 11 is suspended from a shaft 12 which enters the top cover 7 of the cell and supports the anode basket 11 in the electrolyte pool 4. The shaft 12 is provided with means 13 for raising and lowering the anode basket, which allows the anode basket to be lifted out of the electrolyte pool 4 into the position shown by the phantom lines 14, which is a position in the gaseous phase of the cell. The shaft 12 also is provided with rotating means 15, which allows the anode basket 11 to be spun about the axis of the shaft 12 in both the raised and lowered positions. Electrical power is supplied by power means 16.

Figure 2:
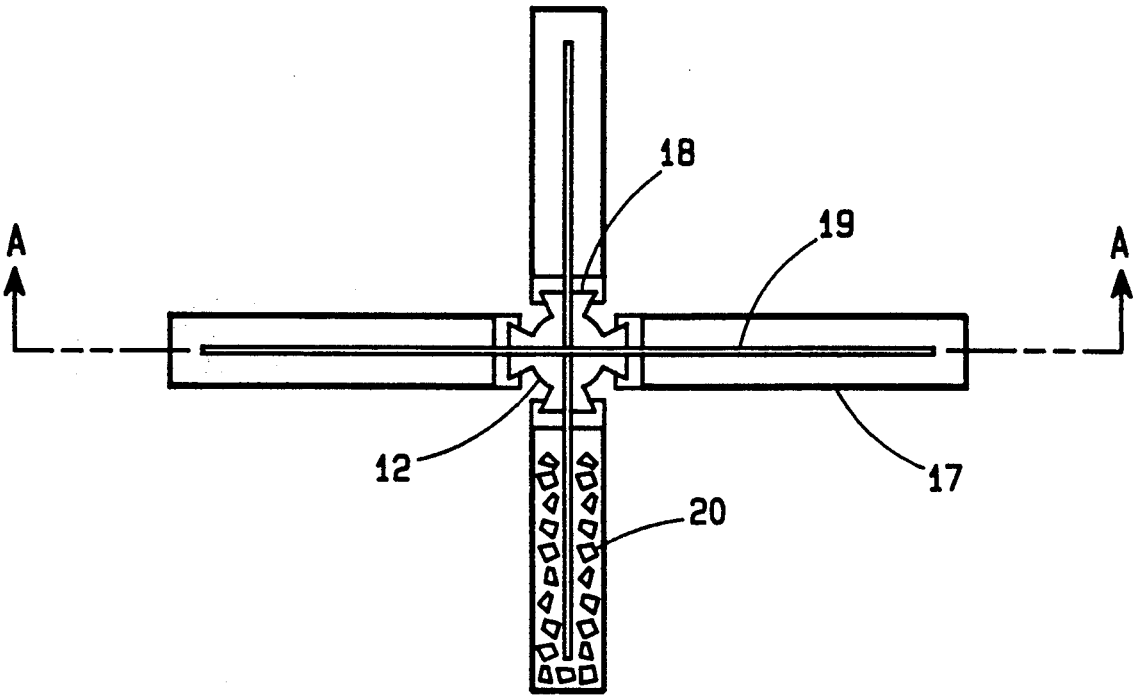
FIG. 2 is a plan view of one embodiment of an improved anode basket assembly suitable for practicing the invention, illustrating the use of a plurality of boxes of perforated metal arranged around a central shaft to contain the chopped pins.
Figure 3:
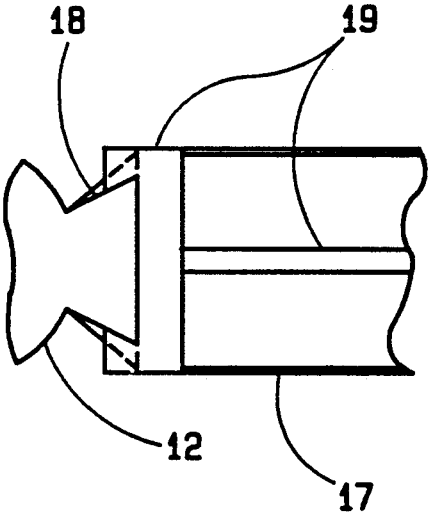
FIG. 3 is a detail illustrating one possible method of attaching the perforated metal boxes to the central shaft.

FIG. 2 is a plan view of one preferred improved anode basket design. In this design, a plurality of perforated metal boxes 17 are arranged radially around the shaft 12. The boxes 17 are attached to the shaft 12 by attachment means 18, which allows the boxes 17 to be detached from the shaft 12 for cleaning or loading, as shown in FIG. 3. Attachment means 18, in this preferred embodiment, comprises four dovetail slides 18, which tapers to form an expanded cross-section as from the top of the slide to its base, allowing the boxes 17 to be removed from the dovetail slide 18 by being vertically lifted upwards off of the dovetail slide (see FIG. 3, which shows the detail of the box attachment). Power is supplied to &:he boxes 17 through the shaft 12, the dovetail slides 18 and current bus 19. The boxes 17 and the current buses 19 preferably are constructed of iron, stainless steel or molybdenum. Electrical contact with the packed bed of chopped pins 20 (shown in FIGS. 2 and 4) contained in the boxes 17 is made by contact between the pin cladding and the walls of the boxes. What is shown is only one method for attaching a box or boxes 17 to the central shaft 12 which is the current source and the means for rotation; other attachment means will suggest themselves to those skilled in the art.

Figure 4:
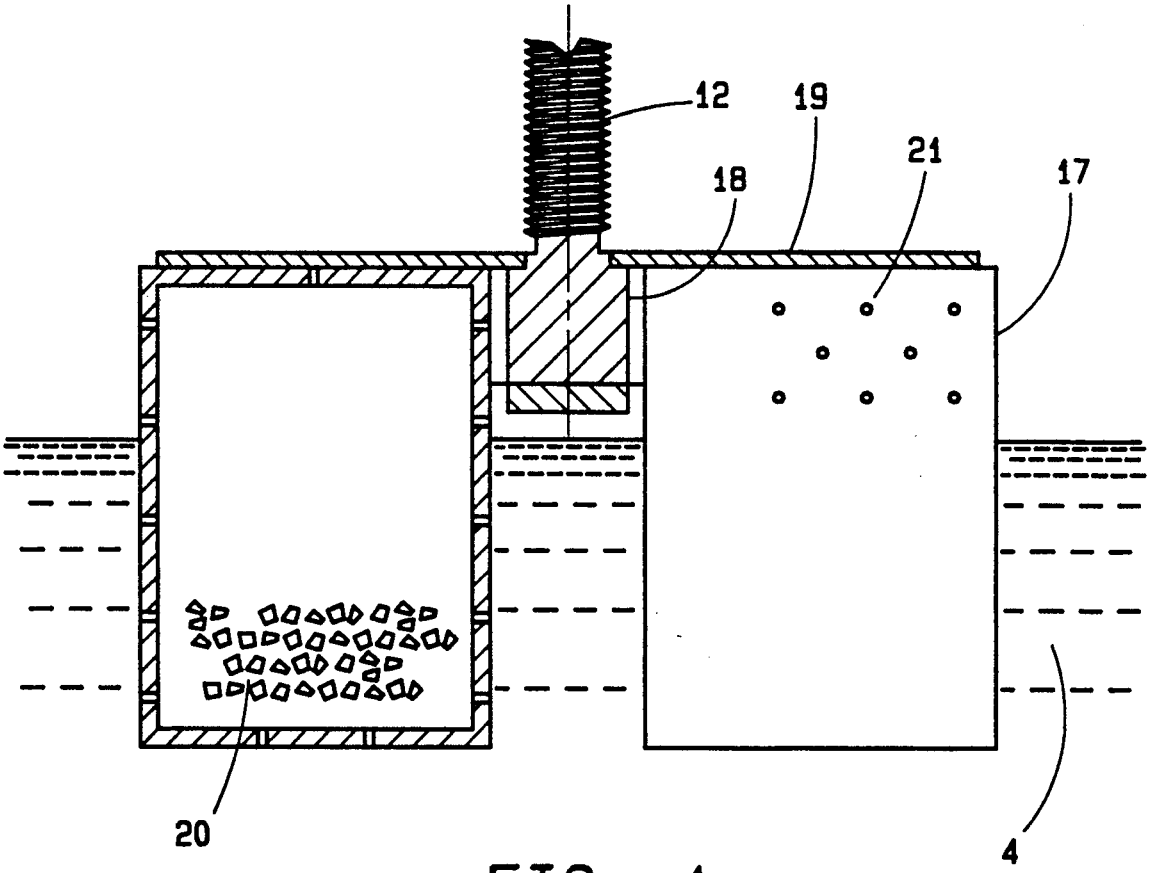
FIG. 4 is a partial sectional view of that assembly along section line A—A, showing its location relative to the electrolyte pool during the anodic dissolution operation.

FIG. 4 is a sectional view of this preferred improved anode basket design along section line A-A, showing the boxes 17 in operation, suspended from shaft 12 in the electrolyte pool 4. When the shaft 12 is rotated about its axis like a vertical paddlewheel, the electrolyte flows through the perforated walls 21 of the boxes 17 and permeates the packed bed of chopped pins 20, carrying away uranium and plutonium cations, as these are formed by the passage of current through the baskets. Metal cladding from the chopped pins is retained in the boxes 17 throughout the operation.

Figure 5:
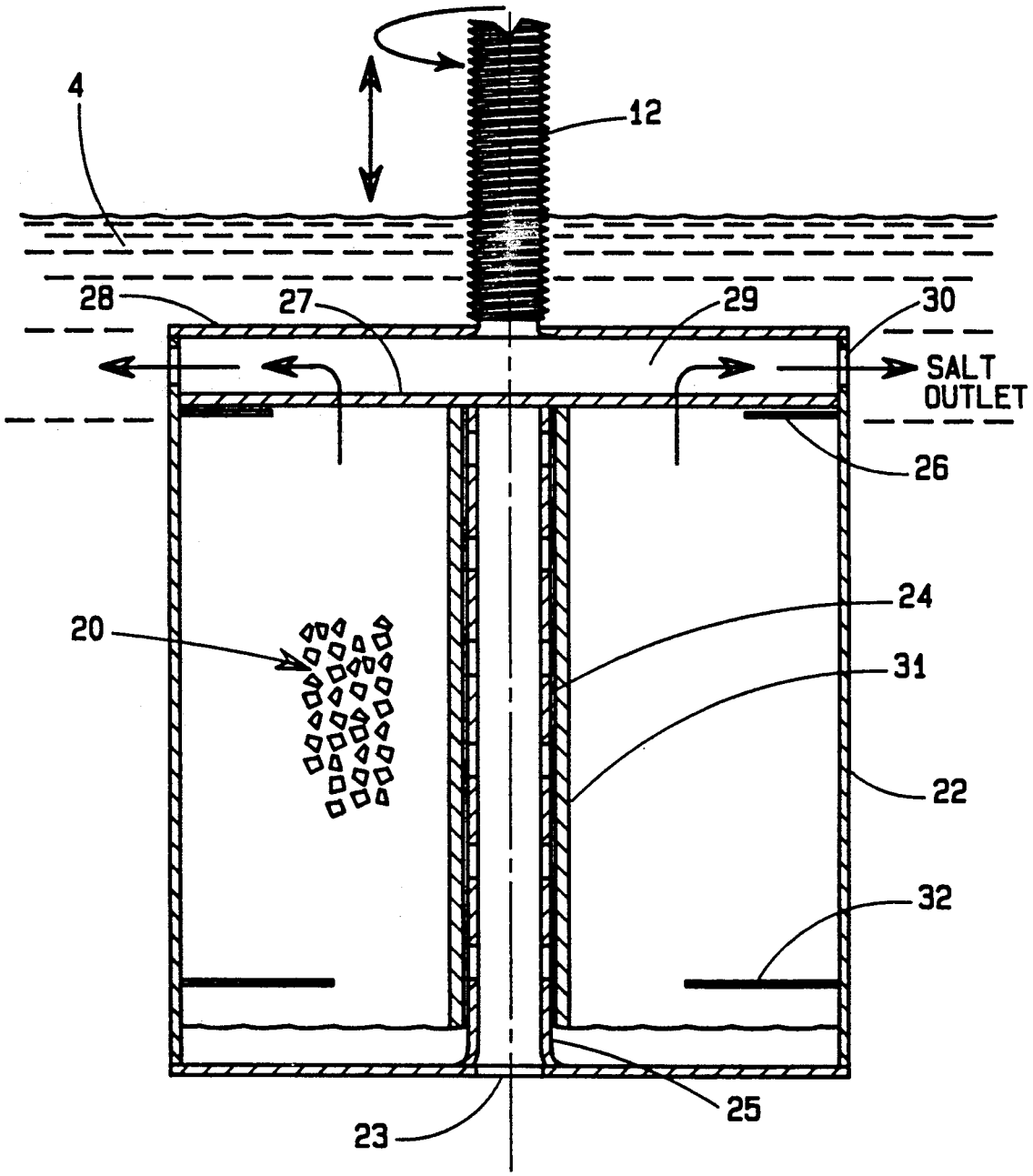
FIG. 5 is a sectional view of another improved anode basket design utilizing cadmium especially suited for practicing the cyclical method of anodic dissolution.

FIG. 5 is a cross-sectional view of another preferred improved anode basket design, which is particularly suitable for cyclic operation of the process of this invention. This anode basket comprises a metal cylindrical housing 22 attached to the shaft 12, which cylinder contains the packed bed of metal-clad pins 20. Situated at the base of the cylindrical housing 22 is an opening 23 through which electrolyte solution from the electrolyte pool 4 can enter the housing 22. A perforated, double-walled cylindrical screen 24 communicates with the opening 23 and extends upward coaxially through the housing 22. A fiber mesh filter 31 fills the annular space between the two walls of the double-walled cylindrical screen 24. The bottom section 25 of the screen 24 is not perforated. A short distance above the base of the housing 22, a ring-shaped solid retainer baffle 32 is attached to the outer wall of the housing 22 and extends radially inward part of the way to the central screen 24. Near the top of the housing 22 an optional similar ring-shaped baffle 26 may be attached to the outside wall of the housing 22 and extends radially inward part of the way toward the central perforated cylindrical screen 24. A disc-shaped mesh filter 27 is attached to the top of the central perforated cylindrical screen 24 and forms the top of the packed bed of chopped pins 20. Above the filter 27 the walls of the housing 22 and its solid top 28 create a disc-shaped plenum 29. A plurality of perforations 30 around the upper wall of the housing 22 communicate between the plenum 29 and the electrolyte pool 4. The center of the top 28 of the housing 22 is attached to the shaft 12. In operation, rotation of the housing 22 about the axis of the shaft 12 impels electrolyte in through the hole 23, up through the central perforated cylindrical screen 24 and into the packed bed of chopped pins 20, from whence the electrolyte flows through the filter 27 and into the plenum 29, to be ejected from the housing 22 through the perforations 30 by centrifugal force.

One preferred embodiment of the process of this invention is as follows. Chopped, spent metal-clad fuel pins are loaded into the perforated screen boxes 17 of an improved anode basket like that shown in FIGS. 2 and 4. The basket assembly 11 (shown in greater detail in FIG. 4) is lowered into the electrolyte pool 4 and spun about the axis of the supporting shaft 12, while direct electrical current is supplied to the shaft 12 and thence through the bus bars 19 to the perforated metal boxes 17 containing the chopped pins 20. The voltage is preferably held below 1.25 volts (absolute value), and more preferably below 1 volt (absolute value). The box construction material is preferably iron, and more preferably nickel or 300 series stainless steel. The use of ferritic alloys containing significant amounts of chromium is contraindicated because of electrochemical corrosion problems. Where there is good electrical contact between the boxes and the chopped pins, uranium and plutonium in the pins are oxidized electrically to form $U^{+3}$ and plutonium cations, which migrate to the cathode 8 where elemental uranium and plutonium are plated out. But at voltages approaching one (1) volt or greater in absolute value, such as may be needed if the electrical contact between the chopped pins and the basket walls is poor, there is a tendency for $U^{+4}$ cations to form as well, by further oxidation of $U^{+3}$ cations already in solution. In conventional anodic dissolution, these higher oxidation state cations migrate to the cathode and are reduced, thus lowering anodic efficiency and wasting electrical power. But in the method of this invention, the electrolyte flushing action produced by the rotation of the basket assembly 11 in the electrolyte pool 4 brings the $U^{+4}$ cations into close contact with the elemental uranium in the pins. The $U^{+4}$ reacts according to mechanisms like:

$$3\,U^{+4} + U_{(s)} \longrightarrow 4\,U^{+3},$$

or:

$$2\,U^{+4} + U_{(s)} \longrightarrow 3\,U^{+3} + 1\,e^{-}.$$

Thus, most of the $U^{+4}$ is chemically consumed in the boxes rather than migrating to the cathode 8. The result is improved anodic efficiency (and therefore reduced electrical power requirements) and higher overall uranium oxidation rates due to the combination of electrical and chemical oxidation mechanisms.

After essentially all of the fissionable material has been oxidized, leaving the metal cladding behind in the boxes, the power is shut off and the improved anode basket assembly 11 (Illustrated in FIGS. 2–4) is raised above the surface of the electrolyte pool 4 into the position shown on FIG. 1 by phantom lines 14 while rotation is continued. Centrifugal force clears the liquid electrolyte from the metal cladding that remains in the boxes after the fissionable material has been oxidized.

In another preferred embodiment of the process, chopped pins are loaded into a cylindrical improved anode basket similar to that shown in FIG. 5 having an electrolyte intake opening 23 situated at the bottom of the basket on the axis of the shaft 12 to which the basket is attached; a reservoir at the bottom of the basket containing a small amount of cadmium (beneath retainer baffle 32); a central electrolyte distributor 24 coaxial with the shaft, in the form of a perforated column, preferably screened with a mesh filter 31, and a plenum chamber 29 at the top of the cylindrical improved anode basket which collects electrolyte that enters the packed bed of chopped pins in the basket from the intake opening 23 and discharges it back into the electrolyte pool 4 by centrifugal force when the basket is rotated. The loaded basket is lowered into the electrolyte pool 4 and a comparatively high voltage is applied, preferably above 1 volt and more preferably above 1.25 volts. This not only causes oxidation of the fissionable materials to soluble cations (including substantial amounts of $U^{+4}$ because of the high voltage used), it also oxidizes the cadmium to $Cd^{+2}$ cations. Use of higher voltages is practical, even with iron baskets, because the presence of cadmium inhibits electrochemical corrosion of the iron, which otherwise would become serious at voltages above about 1.1 volts. The $Cd^{+2}$ cations, like the $U^{+4}$ cations, react with elemental uranium in the pins to form elemental cadmium and $U^{+3}$, respectively, thus regenerating the cadmium, and oxidizing the fuel. The anode basket is periodically rotated, at speeds preferably between 200 and 400 r.p.m., causing fresh electrolyte to enter the intake opening 23, to flow through the packed bed of chopped pins 20 and carry out the uranium and plutonium cations that have been formed, and to exit through the plenum 29 into the bulk electrolyte pool 4. Flushing (rotation) cycles alternate with cycles during which $Cd^{+2}$ is produced and diffuses through the packed bed of pins, reacting with the uranium to form $U^{+3}$, until all of the uranium and plutonium has been oxidized. Rotation is then stopped and the basket is lifted out of the electrolyte pool 4. The bulk of the electrolyte drains out by gravity through the intake opening 23, leaving the cladding material in the basket, and the cadmium drains out of the basket and is trapped in the bottom pool.

EXAMPLE

Ten (10) kg. of simulated chopped fuel pins consisting of non-irradiated U - 10 wt. % Zr alloy clad with mild steel were loaded into an improved anode basket assembly similar to that shown in FIGS. 2, 3, and 4. A 32 hour test was conducted in $LiCl$-$KCl$-$UCl_3$ electrolyte, during the course of which uranium removal rates ranged from 0.5 kg/hr at the beginning of the test to 0.1–0.2 kg/hr during the last 45% of the time. An overall anodic efficiency of about 50% was attained. At the end of the test, the improved anode basket assembly was lifted out of the electrolyte pool and rotated at about 250 r.p.m. This spin-drying operation removed essentially all of the electrolyte from the cladding material residue. Removal of uranium from the chopped pins was essentially complete, and the cladding material was easily recoverable from the basket.

The embodiment of the invention in which an exclusive property or privilege is claimed is defined as follows:

1. A process for separating uranium and plutonium from chopped spent metal-clad fuel pins comprising the steps of:

providing an electrolyte cell having a cadmium pool, an electrolyte pool, an improved anode basket assembly, cathode means, means for flushing said improved anode basket assembly, and means for providing electrical power to said improved anode basket assembly and wherein said improved anode basket assembly comprises a metal shaft having a top end and a bottom end, said top end connected to means for rotation capable of imparting rotation to said shaft, a plurality of perforated metal boxes having means for attaching said plurality of perforated metal boxes around the periphery of the bottom end of said shaft and extending radially outward therefrom, means for lowering and raising said metal boxes into said electrolyte pool and means for carrying an electric current from said electrical power means to said plurality of perforated metal boxes;

loading chopped spent fuel pins having a metal cladding comprising an alloy of uranium and plutonium into said improved anode basket assembly until said chopped spent fuel pins form a tightly packet configuration;

lowering said improved anode basket assembly containing said chopped spent fuel pins to a first position in said electrolyte pool;

providing an electric current from said electrical power means to said improved anode basket assembly and said cathode means at a voltage sufficient to form uranium cations and plutonium cations, and by creating a flushing action of said electrolyte pool through said chopped spent fuel pins by using said means for flushing;

raising said improved anode basket assembly out of said electrolyte pool to a second position and creating a drying action to remove any of said electrolyte pool by using said means for flushing; and recovering said metal cladding from said improved anode basket assembly.

2. The process of claim 1 wherein said improved anode basket assembly further comprises a reservoir filled with molten cadmium, and wherein said electrical current is supplied at a voltage sufficient to oxidize said molten cadmium to form $Cd^{+2}$ cations.

3. The process of claim 2 wherein the absolute value of said voltage exceeds 1.25 volts.

4. The process of claim 2 wherein said step of recovering said metal comprises the additional intermediate steps of stopping said flushing action periodically and allowing said $Cd^{+2}$ cations to diffuse through said chopped spent fuel pins;

allowing said $Cd^{+2}$ cations to react with said uranium in said chopped spent fuel pins to form elemental cadmium and $U^{+3}$ cations;

resuming said flushing action for a period of time sufficient to disperse said $U^{+3}$ cations into said electrolyte pool; and repeating the steps of stopping and resuming said flushing action until essentially all of said uranium and plutonium in said chopped spent fuel pins have been oxidized.

5. The process of claim 4, further comprising the steps of maintaining the absolute value of said voltage below 1 volt while said anode basket assembly is rotating, and maintaining the absolute value of said voltage above 1.25 volts while said anode basket assembly is not rotating.

6. The process of claim 4 wherein said step of creating said flushing action comprises spinning said improved anode assembly about the axis of said shaft allowing said electrolyte pool to flow and permeate through said chopped spent fuel pins and out said perforated metal boxes.

7. A process for separating uranium and plutonium from chopped spent metal-clad fuel pins comprising the steps of:

providing an electrolyte cell having a cadmium pool, an electrolyte pool, an improved anode basket assembly, cathode means, means for flushing, and means for providing electrical power to said improved anode basket assembly wherein said improved anode basket assembly comprises a metal shaft having a top and a bottom end, means for attaching and capable of imparting rotation to said shaft, a cylindrical metal exterior shell having means for attaching said cylindrical metal exterior shell coaxially to the bottom end of said shaft, a cylindrical wall, a circular bottom plate and a circular top plate attached to said shaft, means for retaining molten cadmium in the bottom of said cylindrical exterior metal shell, means for lowering and raising said cylindrical metal shell into said electrolyte pool, an intake opening coaxial to said shaft, a perforated metal cylinder inside of said cylindrical metal shell, a metal screen mounted coaxially on said perforated meal cylinder, a plenum formed by said metal screen said cylindrical wall and said circular top plate, and a plurality of outlet holes located at the periphery of said plenum;

loading chopped spent fuel pins having a metal cladding comprising an alloy of uranium and plutonium into said improved anode basket assembly until said chopped spent fuel pins form a tightly packet configuration;

lowering said improved anode basket assembly containing said chopped spent fuel pins into said electrolyte pool to a first position;

providing an electric current from said electrical power means to said improved anode basket assembly and said cathode means at a voltage sufficient to form uranium cations and plutonium cations, and creating as flushing action of said electrolyte pool through said chopped spent fuel pins by using said means for flushing;

raising said improved anode basket assembly out of said electrolyte pool to a second position and creating a drying action to remove any of said electrolyte pool by using said means for flushing; and recovering said metal cladding from said improved anode basket assembly.

8. The process of claim 1 or 7 wherein the absolute value of said voltage is less than 1 volt.

9. The process of claim 7 wherein said step of creating a flushing action comprises spinning said improved anode basket assembly about the axis of said shaft to force said electrolyte pool to flow through said opening across said chopped spent fuel pins and out through said plenum.

10. The process of claim 6 or 9 wherein said alkali metal halide salts comprising said electrolyte pool are selected from the group consisting of LiCl, KCl, $CaCl_2$, and $BaCl_2$.

11. The process of claim 6 or 9 in which the temperature of said electrolyte pool is maintained between 450 and 525 degrees centigrade.

12. The process of claim 6 or 9 wherein said anode basket assembly is constructed of a metal selected from the group consisting of iron, nickel, 300 series stainless steel and molybdenum.

13. An improved rotatable anode basket assembly suitable for recovering uranium and plutonium from chopped spent fuel pins, comprising:

metal shaft having a top end and a bottom end;

means for attaching and capable of imparting rotation to said shaft;

a plurality of perforated metal boxes connected to said means for attaching and detachably mounted around the periphery of the bottom end of said shaft and extending radially outward therefrom;

means for lowering and raising said metal boxes into an electrolyte pool; and means for generating and transferring an electric current to said plurality of perforated metal boxes.

14. An improved rotatable anode basket assembly suitable for recovering uranium and plutonium from chopped spent fuel pins, comprising:

a metal shaft having a top and a bottom end;

means for attaching and capable of imparting rotation to said shaft;

a cylindrical metal exterior shell connected to said means for attaching and mounted coaxially to the bottom end of said shaft, a cylindrical wall, a circular bottom plate, and a circular top plate attached to said shaft;

means for retaining molten cadmium in the bottom of said cylindrical exterior metal shell and wherein said means for retaining molten cadmium includes a baffle;

means for lowering and raising said cylindrical metal shell into an electrolyte pool rotatably attached to said top end of said shaft;

an intake opening coaxial to said shaft;

a perforated metal cylinder inside of said cylindrical metal shell having means for filtering;

a metal screen mounted coaxially on said perforated metal cylinder;

a plenum formed by said metal screen, said cylindrical wall and said circular top plate; and a plurality of outlet holes located at the periphery of said plenum.

15. The anode basket assemblies of claim 13 or 14 wherein said assemblies are fabricated of a metal selected from the group consisting of iron, nickel, 300 series stainless steel and molybdenum.

* * * * *